US009014608B2

(12) United States Patent
Okayasu et al.

(10) Patent No.: US 9,014,608 B2
(45) Date of Patent: Apr. 21, 2015

(54) IMAGE HEATING APPARATUS

(75) Inventors: Kohei Okayasu, Mishima (JP); Satoshi Nishida, Numazu (JP)

(73) Assignee: Canon Kabushiki Kaisha, Toyko (JP)

( * ) Notice: Subject to any disclaimer, the term of this patent is extended or adjusted under 35 U.S.C. 154(b) by 191 days.

(21) Appl. No.: 13/488,967

(22) Filed: Jun. 5, 2012

(65) Prior Publication Data

US 2012/0328341 A1 Dec. 27, 2012

(30) Foreign Application Priority Data

Jun. 21, 2011 (JP) ..... 2011-137209

(51) Int. Cl.
*G03G 15/20* (2006.01)

(52) U.S. Cl.
CPC ..... *G03G 15/2042* (2013.01); *G03G 15/2057* (2013.01); *G03G 15/206* (2013.01)

(58) Field of Classification Search
CPC ..... G03G 15/2089
USPC ..... 399/328, 329, 330, 333
See application file for complete search history.

(56) References Cited

U.S. PATENT DOCUMENTS

| | | | | |
|---|---|---|---|---|
| 7,203,438 | B2 | 4/2007 | Omata et al. | |
| 7,254,362 | B2 * | 8/2007 | Kikuchi et al. | 399/333 |
| 7,392,006 | B2 * | 6/2008 | Kameda et al. | 399/329 |
| 7,519,320 | B2 | 4/2009 | Aoki et al. | |
| 7,650,105 | B2 | 1/2010 | Ogawa et al. | |
| 7,702,249 | B2 | 4/2010 | Nishida | |
| 7,734,241 | B2 | 6/2010 | Nishida et al. | |
| 7,787,792 | B2 | 8/2010 | Nishida | |
| 8,208,844 | B2 | 6/2012 | Omata et al. | |
| 2007/0059060 | A1 | 3/2007 | Kameda et al. | |
| 2009/0003902 | A1 | 1/2009 | Sakakibara et al. | |
| 2009/0285611 | A1 | 11/2009 | Omata et al. | |
| 2009/0317154 | A1 * | 12/2009 | Nishinoue et al. | 399/329 |
| 2010/0260523 | A1 | 10/2010 | Nishida et al. | |

(Continued)

FOREIGN PATENT DOCUMENTS

| | | | |
|---|---|---|---|
| CN | 102043371 | A | 5/2011 |
| CN | 102081332 | A | 6/2011 |

(Continued)

OTHER PUBLICATIONS

European Search Report dated Oct. 2, 2012, in counterpart European Application No. 12171742.5-2216.

(Continued)

*Primary Examiner* — Sandra Brase
(74) *Attorney, Agent, or Firm* — Fitzpatrick, Cella, Harper & Scinto

(57) ABSTRACT

An image heating apparatus for heating a recording material, on which a toner image is carried, while conveying the recording material in a nip includes: a fixing roller including a metal core, a heat insulating layer formed on a surface of the core metal, and a high heat transfer layer which is formed on an outer peripheral surface of the heat insulating layer and has a higher thermal conductivity than the heat insulating layer; a heating member for heating the fixing roller from an outside; and a back-up member for forming the nip together with the fixing roller. When the fixing roller and the back-up member opposing the fixing roller are supplied with the same heat quantity, the temperature rise rate in a neighborhood of the surface of the back-up member supplied with the heat quantity is higher than that of the fixing roller.

15 Claims, 7 Drawing Sheets

(56) References Cited

U.S. PATENT DOCUMENTS

| | | | |
|---|---|---|---|
| 2011/0236084 | A1 | 9/2011 | Nishida et al. |
| 2012/0155938 | A1 | 6/2012 | Tanaka et al. |

FOREIGN PATENT DOCUMENTS

| | | | |
|---|---|---|---|
| JP | 2004-101608 | A | 4/2004 |
| JP | 2005-157303 | A | 6/2005 |
| JP | 2007-79036 | A | 3/2007 |
| JP | 2007-121441 | A | 5/2007 |
| JP | 2008-216806 | A | 9/2008 |
| JP | 2009-276419 | A | 11/2009 |

OTHER PUBLICATIONS

Korean Office Action dated Aug. 12, 2014, issued in counterpart Korean Application No. 10-2012-0066012.

English-language translation of Korean Office Action dated Aug. 12, 2014, issued in counterpart Korean Application No. 10-2012-0066012.

Chinese Office Action dated Oct. 31, 2014, issued in counterpart Chinese Application No. 201210211615.X, and English-language translation thereof.

* cited by examiner (1) INSULATING FIRE BRICK (2) POLYESTER RESIN (3) HIGH-ALUMINA BRICK (4) MAGNESIA BRICK

IMAGE HEATING APPARATUS

FIELD OF THE INVENTION AND RELATED ART

The present invention relates to an image heating apparatus suitably used as an image fixing device (apparatus) mounted in an image forming apparatus such as an electrophotographic copying machine or an electrophotographic laser beam printer, and relates to the image forming apparatus in which the image heating apparatus is mounted.

As the image heating apparatus, a fixing device for heat-fixing an unfixed image, as a fixed image, formed on a actually measured and a glossiness increasing device (image modifying device) for increasing glossiness of an image, fixed on the recording material, by re-heating the image are cited.

As the image heating apparatus (fixing device) used in equipment, using an electrophotographic process, such as the electrophotographic copying machine, a facsimile machine or a printer, those of a heating roller type has been conventionally used in general. The fixing device of the heating roller type includes a fixing roller and a pressing roller press-contacted to the fixing roller to form a fixing nip. Further, either one or both of these rollers are internally heated and the recording material on which the unfixed image is carried is nip-conveyed in the fixing nip, so that the unfixed image is fixed as the fixed image on the recording material by heating and pressure application.

In order to meet the demand for a high-speed image forming apparatus by the fixing device of the heating roller type, there is a need to increase the nip width, with respect to a recording material conveyance direction, for permitting sufficient application of heat to the recording material in the fixing nip. Further, also in order to alleviate a degree of image non-uniformity on the recording material, there is a need to provide the fixing roller with an elastic layer. However, in the conventional fixing roller of the heating roller type including the elastic layer, the thermal capacity of the fixing roller is large, and therefore the fixing roller surface is increased in temperature to a predetermined temperature by heat transfer from an inner surface of the fixing roller via the elastic layer having a large thickness. For that reason, a first print out time (FPOT) becomes long.

As a countermeasure against the above problem, a fixing device of an external heating type is proposed in Japanese Laid-Open Application 2004-101608. This fixing device includes a fixing roller, a back-up member for forming a sheet conveying nip (fixing nip) together with the fixing roller, and a heating member for heating an outer peripheral surface of the fixing roller. In order to obtain a nip width for ensuring a fixing property, the fixing roller includes an elastic layer, and the fixing roller is heated from its surface side in order to quickly increase the surface temperature of the fixing roller to a fixable temperature.

Further, in order to quickly increase the fixing roller surface temperature rise, the fixing roller is provided with a thin heat transfer layer inside an outermost layer which is parting layer and is further provided with a heat insulating layer inside the high heat transfer layer.

Thus, by decreasing the thermal capacity of the fixing roller, it becomes possible to realize a faster temperature rise of the fixing roller. Further, as the back-up member, a pressing roller or a pressing pad for forming the fixing nip between the fixing roller and a film pressed by the pressing pad, or the like member would be considered. By reducing the thermal capacity of the back-up member, the FPOT can be further shortened.

SUMMARY OF THE INVENTION

A principal object of the present invention is to provide an image heating apparatus capable of suppressing a non-sheet-passing portion temperature rise of a fixing roller while shortening FPOT by decreasing a thermal capacity of the fixing roller.

According to an aspect of the present invention, there is provided an image heating apparatus for heating a recording material, on which a toner image is carried, while conveying the recording material in a nip, the image heating apparatus comprising: a fixing roller including a metal core, a heat insulating layer formed on an outer peripheral surface of the metal core, and a high heat transfer layer which is formed on an outer peripheral surface of the heat insulating layer and has a higher thermal conductivity than the heat insulating layer; a heating member for heating a surface of the fixing roller from an outside of the fixing roller; and a back-up member for forming the nip together with the fixing roller, wherein when the surface of the fixing roller and a surface of the back-up member opposing the surface of the fixing roller are supplied with the same heat quantity, a temperature rise rate in a neighborhood of the surface of the back-up member supplied with the heat quantity is higher than that of the fixing roller.

According to the present invention, it is possible to suppress the non-sheet-passing portion temperature rise of the fixing roller while shortening the FPOT by decreasing the thermal capacity of the fixing roller.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS (Embodiment 1)

A first exemplary embodiment is described.

(1) Image Forming Portion

Figure 1:
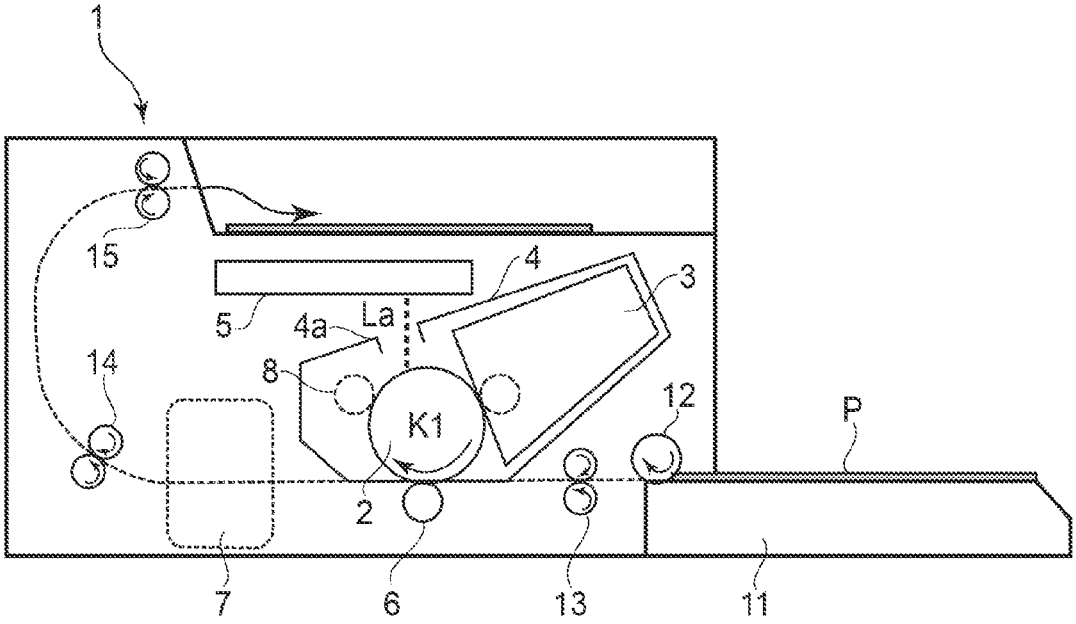
FIG. 1 is a sectional view showing a schematic structure of an image forming apparatus provided with a fixing device in Embodiment 1.

FIG. 1 is a sectional view showing a schematic structure of an example of an image forming apparatus 1 in which an image heating apparatus according to the present invention is mounted as a fixing device 7. This apparatus 1 is a laser beam printer of an electrophotographic type. Into the printer 1, image information is inputted from an image information providing device (external host device) such as a host computer or the like provided outside the printer 1. Further, the printer 1 performs, by an electrophotographic method, a series of image forming processes such that an image depending on the inputted image information is formed and recording on a sheet-like recording material P.

The printer 1 includes a process cartridge 4 in which a drum-like rotatable electrophotographic photosensitive member 2 as an image bearing member, a primary charging mechanism 8 and a developing device 3 are held. Further, the printer 1 includes a laser scanner unit (hereinafter referred to as a scanner) 5 for forming an electrostatic latent image depending on the image information on an outer peripheral surface of the photosensitive member 2 by an exposure (process) step depending on the image information inputted from the image information providing device. Further, the printer includes a roll-like rotatable transfer member 6 for transferring the image onto the recording material P and the fixing device 7 as the image heating apparatus for fixing the image on the recording material P, which has been subjected to the image transfer, by heating and pressure application.

The primary charging mechanism 8 is configured to charge the outer peripheral surface of the rotating photosensitive member 2 to have a predetermined potential distribution by being supplied with a predetermined bias from a commercial power source or the like before the exposure step with the scanner 5. The scanner 5 outputs laser light La modulated depending on the image information from the image information providing device. The charged portion of the outer peripheral surface of the photosensitive member 2 is subjected to scanning exposure to the laser light La through a window 4*a* provided to the process cartridge 4. As a result, the electrostatic latent image depending on the image information is formed on the outer peripheral surface of the photosensitive member 2.

Next, the series of image forming processes in the printer 1 will be described. First, rotational driving of the photosensitive member 2 is started, so that the photosensitive member 2 is rotated in the clockwise direction indicated by an arrow K1 at a predetermined peripheral speed. At the same time, the outer peripheral surface of the photosensitive member 2 is charged to have the predetermined potential distribution by the primary charging mechanism 8 to which the predetermined bias is applied.

Next, depending on the image information from the image information providing device, the charged portion of the outer peripheral surface of the photosensitive member 2 is subjected to the scanning exposure by the scanner 5. As a result, the electrostatic latent image depending on the image information is formed on the above portion of the photosensitive member 2. The electrostatic latent image is developed with a developer in the developing device 3 to be visualized as a toner image.

On the other hand, by a sheet-feeding roller 12 driven with a predetermined timing, sheets of the recording material P are separated and fed one by one from a sheet-feeding cassette 11. In the sheet-feeding cassette 11, a plurality of the sheets of the recording material P are stacked and accommodated. The recording material P fed from the sheet-feeding cassette 11 is conveyed to a transfer nip, formed between the photosensitive member 2 and the transfer member 6, by a conveying roller 13 with a predetermined timing and then is nip-conveyed in the transfer nip. In this conveying process in the transfer nip, the toner image on the photosensitive member 2 is sequentially transferred onto the recording material P.

Then, the recording material P subjected to the transfer process is subjected to a fixing process by the fixing device under heat and pressure and thereafter is discharged to the outside of a main assembly of the printer 1 by a sheet-discharging roller 15 via a conveying roller 14 which is rotatably supported. The discharged sheets of the recording material P are stacked on a tray mounted at an upper surface of the printer 1. As described above, the series of image forming processes are ended. On the other hand, a residual toner remaining on the photosensitive member 2 after the transfer process is collected by an unshown cleaning mechanism.

(2) Fixing Device 7

Figure 2:
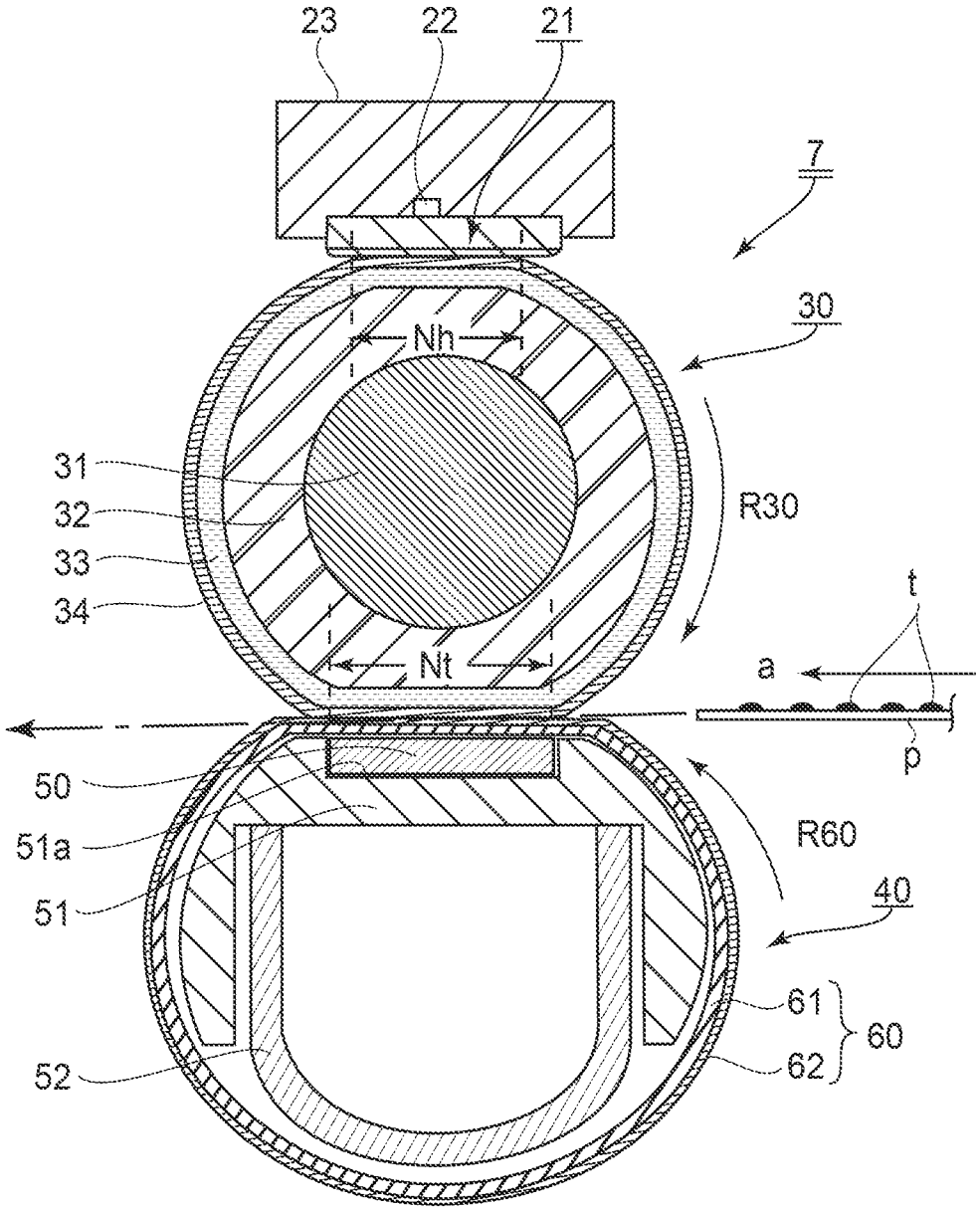
FIG. 2 is a sectional view showing a schematic structure of the fixing device in Embodiment 1.
Figure 3:
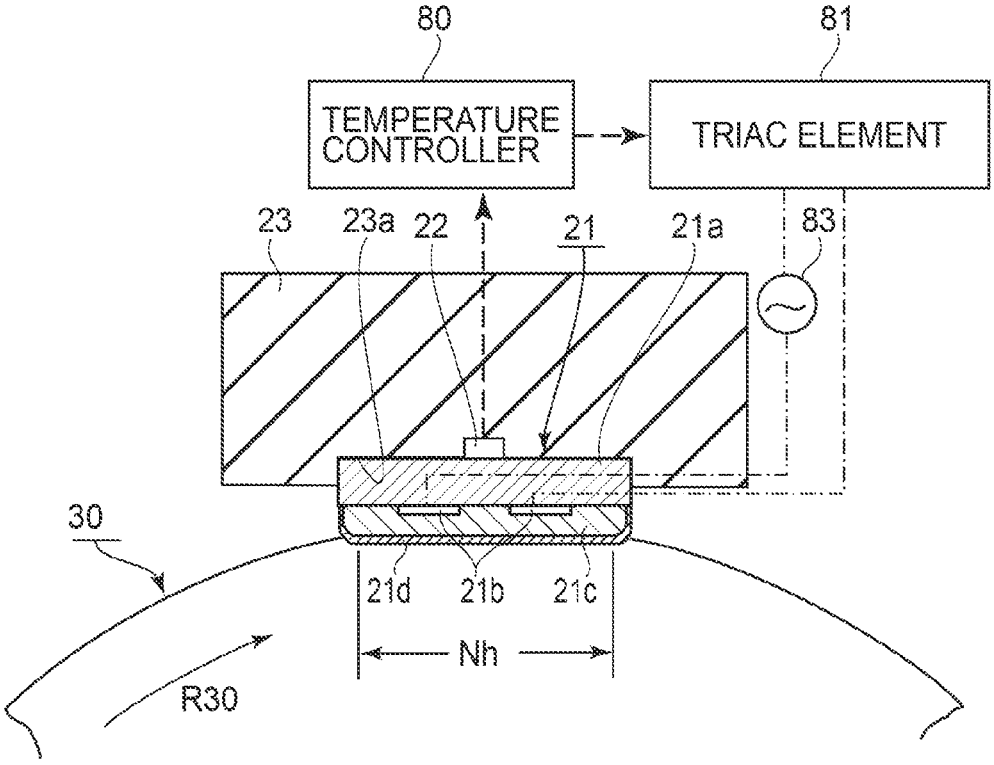
FIG. 3 includes an enlarged view in the neighborhood of a heat press-contact portion of the fixing device shown in FIG. 2 and a block diagram of a temperature control system.

FIG. 2 is a sectional view showing a schematic structure of the fixing device. FIG. 3 includes an enlarged view in the neighborhood of a heat press-contact portion of the fixing device shown in FIG. 2 and a block diagram of a temperature control system.

In the following description, a longitudinal direction of the fixing device or members constituting the fixing device is an axial direction (thrust direction) of a rotatable member or a direction perpendicular to a recording material conveyance direction a in a plane of a recording material conveyance path. Further, a widthwise direction is a direction parallel to the recording material conveyance direction a. A width size of the recording material or a sheet-passing width of the recording material is a dimension on the recording material surface with respect to the direction perpendicular to the recording material conveyance direction a.

The fixing device 7 is the image heating apparatus of an external heating type using, as a back-up member, a member including a film and a pressing (urging) pad. The fixing device 7 includes a fixing roller 30 having a heat insulating layer. Further, the fixing device 7 includes a plate-like heater 21 as a heating member for externally heating the fixing roller 30. Further, the fixing device 7 includes a back-up member 40 including a film 60 and a pressing pad 50 for pressing the film 60 to form a fixing nip Nt between the film 60 and the roller 30. Further, the fixing device 7 is a device such that an image t on the recording material P is heated by heat of the roller 30 while nip-conveying the recording material P in the fixing nip Nt.

(2-1) Fixing Roller 30

The roller 30 has elasticity and an outer diameter of 17.5 -18 mm. The roller 30is a composite member in which on an outer peripheral surface of a metal core 31, three layers consisting a heat insulating layer (base layer) 32, a high heat transfer layer 33, which has a thermo-conductivity higher than that of the heat insulating layer 32, and a parting layer 34, which is a surface layer (outermost layer), are laminated concentrically integrally from the inside to the outside in this order.

In this embodiment, the metal core 31 is a cylindrical metal rod (bar) member formed of 10 mm in outer diameter and of iron, stainless steel (SUS), aluminum or the like. The heat insulating layer 32 is a 3.5 mm-thick elastic layer formed principally of a silicone rubber (foam rubber) having a high heat insulating property. The high heat transfer layer 33 is a 200μm-thick high heat transfer rubber layer formed principally of an alumina rubber or the like. The parting layer 34 is a 10μm-thick material layer which has a high parting property and which is formed principally of PTFE, PFA, FEP or the like.

The roller 30 has a structure such that the high heat transfer layer 33 thinner than the heat insulating layer 32 is provided inside the parting layer in order to increase a temperature rise rate of the surface of the roller 30.

The roller 30 is rotatably supported by a (fixing) device casing at both end portions of the metal core 31. Further, the roller 30 is rotated in the clockwise direction indicated by an arrow R30 at a predetermined speed by receiving a driving force from an unshown driving force.

The plate-like heater 21, which is the heating member, for externally heating the roller 30 is a ceramic heater elongated in a longitudinal direction of the roller 30. This heater 21 includes a 1.0 mm-thick elongated ceramic substrate 21*a* and an energization heat generating resistance layer 21*b* formed on a surface of the substrate 21*a* along the longitudinal direction of the substrate 21*a*. In this embodiment, the resistance layer 21*b* was formed by screen-printing a heat generating material paste of silver and palladium in a thickness of 10 μm and then by sintering the paste.

Further, on the surface of the substrate 21*a* on which the resistance layer 21*b* is formed, a 30 μm-thick insulating glass layer is formed as a protective layer 21*c* for protecting the resistance layer 21*b*, and thereon a 10 μm-thick sliding layer 21*d* of PFA resin is provided.

To a longitudinal central portion of a surface of the substrate 21*a* opposite from the surface where the resistance layer 21*b* is formed, a thermistor 22 as a temperature detecting member for the heater 21 is contacted.

The heater 21 is held by a holder 23 which has high rigidity and high heat resistance and which is formed of a liquid crystal polymer member. The holder 23 has a shape elongated in the longitudinal direction of the heater 21 and is provided with a groove 23*a*, for engaging the heater 21 therein, along the longitudinal direction of the heater 21. The heater 21 is engaged in and held by the groove 23*a* of the holder 23 with the resistance layer 21*b*-formed surface outward (toward the roller 30).

The holder 23 is disposed so that the heater 21 held by the holder 23 opposes the roller 30. Further, the holder 23 is urged by an unshown urging mechanism so that the heater 21 is press-contacted to the surface of the roller 30 against the elasticity of the roller 30 under predetermined pressure. As a result, a heat press-contact portion Nh with a predetermined width is formed between the roller 30 and the heater 21. In this embodiment, the pressure of 14 kgf is applied between the heater 21 and the roller 30, so that the width of the heat press-contact portion is 7 mm.

(2-3) Back-Up Member 40

The back-up member 40 includes the cylindrical film 60 and the pressing pad 50 for pressing the film 60 to form the fixing nip Nt between the film 60 and the roller 30.

In this embodiment, the film 60 is a composite layer film having a base layer 61 of 18 mm in outer diameter and 60 μm in thickness and a parting layer 62, of PFA in a thickness of 10 μm, as a surface layer formed on the outer peripheral surface of the base layer 61.

As a material for the pad 50, in order to form the fixing nip Nt between the film 60 and the roller 30 to uniformize a temperature in the fixing nip Nt with respect to the longitudinal direction, a material excellent in the thermo-conductivity may desirably be used. Further, the material may desirably have a thermal capacity to the degree that the pad 50 takes the heat from the roller 30 more than necessary. Further, the material is also required to have a mechanical strength such that the fixing nip Nt has a nip shape uniform with respect to the longitudinal direction. Therefore, as the material for the pad 50, a metal material such as SUS, iron or aluminum may desirably be used. In this embodiment, the pad 50 was an aluminum plate of 6.5 mm in width and 1 mm in thickness.

The pad 50 has a substantially semicircular though shape in cross-section and is held by a holder 51 formed of a liquid crystal polymer. The holder 51 is provided with a groove 51*a* for engaging the pad 50 therein along the longitudinal direction of the pad 50, so that the pad 50 is engaged in the groove 51*a* and thus is held by the holder 51. Further, in a side of the holder 51 opposite from the side where the pad 50 is engaged, a stay (supporting member) 52 having a U-shape in cross-section is provided. In this embodiment, a material for the stay 52 is iron.

The film 60 is externally engaged with the holder 51 loosely.

The back-up member 40 is disposed so that the pad 50 opposes the roller 30. Further, the heater 21 and the pad 50 are disposed opposed to each other via the roller 30. Further, a stay 52 is urged by an unshown urging mechanism so that the pad 50 is press-contacted to the surface of the film 60 toward the roller 30 against the elasticity of the roller 30 under predetermined pressure. As a result, the fixing nip Nt with a predetermined width is formed between the roller 30 and the film 60.

In this embodiment, the pressure of 15 kgf is applied between the roller 30 and the pad 50, so that the width of the fixing nip Nt is 7 mm.

(2-4) heat-fixing operation

Immediately before the fixing device 7 performs a series of operations of image heat fixation, a width size of the recording material P to be passed through the fixing device 7 is detected by an unshown paper (sheet) size detecting member.

The roller 30 is rotationally driven in the clockwise direction indicated by the arrow R30 direction at the predetermined speed by receiving the driving force from the unshown driving source. The roller 30 is rotated while being intimately contacted to and slid on the surface of the heater 21 in the heat press-contact portion Nh.

Further, the film 60 of the back-up member 40 is rotated in the counterclockwise direction indicated by an arrow R60 by the rotation of the roller 30 through a frictional force with the roller 30 in the fixing nip Nt. At that time, the inner surface of the film 60 is rotated while being intimately contacted to and slid on the pad 50. Further, the holder 51 also functions as a rotation guide member for the film 60.

Then, a (temperature) controller 80 shown in FIG. 3 turns on a triac element 81 as an energization driving member to start energization from an AC power source 83 (commercial power source) to the resistance layer 21*b* through an unshown electrode portion provided at a longitudinal end portion of the substrate 21*a* of the heater 21. The resistance layer 21*b* generates heat by the energization, so that the heater 21 is increased in temperature by the heat generation of the resistance layer 21*b*. The heater 21 itself has a low thermal capacity and therefore temperature rise thereof is quick. The rise temperature of the heater 21 is detected by the thermistor 22 provided on the substrate 21*a*, and a detection signal of the thermistor 22 is taken into the controller 80.

The controller 80 controls the energization to the resistance layer 21*b* by turning on and off the triac element 81 on the basis of the detection signal, thus keeping the temperature of the heater 21 detected by the thermistor at a target temperature. The surface of the roller 30 is heated by the heater 21, so that the surface temperature of the roller 30 reaches a fixable temperature at which the toner is melted and fixed on the recording material P.

A control method of the heater 21 in this embodiment is of a type in which a duty ratio, a wave number or the like of a commercial power source voltage applied to the resistance layer 21*b* is appropriately controlled depending on the detection signal. The control method (type) of the heater 21 is not limited thereto but (the temperature of) the heater 21 may also be controlled by directly detecting the surface temperature of the roller 30 by the temperature detecting member 30.

In a state in which the detection temperature of the heater 21 by the thermistor 22 is raised to the target temperature, the recording material on which the unfixed toner image t is carried is guided into the fixing nip Nt. In the fixing nip Nt, the recording material P is nip-conveyed by the surface of the roller 30 and the surface of the film 60. Further, during the nip-conveyance, the unfixed toner image t on the recording material P is subjected to application of heat and pressure, so that the unfixed toner image t is heat-fixed as a fixed image on the recording material P.

As described above, by controlling the heater 21 so that the detection temperature of the heater 21 is the target temperature, it is possible to not only keep the fixing property on the recording material P at a constant level, but also to prevent an image defect, such as a hot offset generated by excessively providing the heat to the recording material P.

(3) Countermeasure Against Temperature Non-Uniformity (3-1) Mechanism of Temperature Non-Uniformity When the thermal conductivity of the roller 30 is large, the heat in the roller 30 can be quickly uniformized by the roller 30 itself. On the other hand, when the thermal conductivity of the roller 30 is small, it takes much time to uniformize a temperature difference and therefore the temperature non-uniformity is liable to occur with respect to the longitudinal direction of the roller 30. Thus, the temperature non-uniformly is closely associated with the thermal conductivity.

In the case of the external heating type using the fixing roller having the small thermal conductivity, the temperature non-uniformity is liable to occur with respect to the fixing roller longitudinal direction due to the small thermal conductivity of the fixing roller. For example, in the case where sheets of a recording material (narrow-width recording material) having a width narrower than a maximum sheet-passing region are continuously passed through the fixing device, the temperature of a portion (non-sheet-passing portion), of a whole portion of the fixing roller, through which the narrow-width recording material does not pass becomes higher than the temperature of a portion (sheet-passing portion) through which the narrow-width recording material is passed. Therefore, when a recording material that is larger in width than the narrow-width recording material is passed through the fixing device immediately after the end of sheet passage of the narrow-width recording material, there arises a problem (non-sheet-passing portion temperature rise) such that an improper image quality is obtained because of the difference in fixing property caused due to the difference in temperature of the fixing roller between the sheet-passing portion and non-sheet-passing portion for the narrow-width recording material.

This non-sheet-passing portion temperature rise occurs conspicuously when the thermal conductivity of the fixing roller is small. For that reason, the external heating type required to decrease the thermal conductivity of the fixing roller is disadvantageous in terms of the non-sheet-passing portion temperature rise as compared to a fixing type apparatus in which the heater is incorporated in the roller. Further, with a higher FPOT, there is a need to decrease the thermal conductivity of the fixing roller, and therefore the problem of the non-sheet-passing portion temperature rise becomes more severe. In order to suppress the non-sheet-passing portion temperature rise, when the thermal conductivity of the fixing roller is increased, the FPOT becomes low. That is, the increase in FPOT and the suppression of the non-sheet-passing portion temperature rise stand in a trade-off relationship.

Therefore, in a conventional fixing device, in order to suppress the occurrence of an image defect due to the non-sheet-passing portion temperature in the constitution in which the thermal conductivity of the fixing roller is small, the time required for eliminating the temperature difference of the fixing roller was provided in a period from the end of the continuous sheet passage of the narrow-width recording material to the start of the sheet passage of the wide-width recording material.

However, this method was accompanied with a problem that productivity was considerably lowered.

(3-2) Mechanism of Temperature Non-Uniformity Prevention

In the above-described fixing device 7, when the heat of the roller 30 is transferred to the pad 50 via the film 60 of the back-up member 40, the pad 50 will uniformize the heat in the pad 50 in order to maintain a thermal equilibrium state. This heat-uniformizing rate is higher with a larger thermal conductivity of the pad 50.

In the case where the thermal conductivity of the back-up member 40 exceeds the thermal conductivity of the roller 30, the pad 50 easily effects heat exchange in the nip Nt via the film 60. For that reason, even when the temperature difference is generated, with respect to the longitudinal direction of the roller 30, due to the non-sheet-passing portion temperature rise or the like, the pad 50 promotes a decrease in temperature difference. Therefore, even in the case where the non-sheet-passing portion temperature rise is generated, the pad 50 decreases the temperature difference of the roller 30 between the non-sheet-passing portion and the sheet-passing portion, so that the non-sheet-passing portion temperature rise is suppressed.

Thus, the temperature non-uniformity due to the non-sheet-passing portion temperature rise depends on easiness of transfer of thermal energy of each of the roller 30 and the back-up member 40 (hereinafter referred to as an actually measured thermal conductivity).

This embodiment is characterized in that the actually measured thermal conductivity of the back-up member 40 at the surface where the fixing nip Nt is formed is larger than that of the fixing roller 30.

(3-3) Measurement of Actually Measured Thermal Conductivity

In this embodiment, measurement of the actually measured thermal conductivity is made by using a method which is called a "non-steady hot wire method". Specifically, by using the non-steady hot wire method (probe method) using a measuring device ("QTM-500", mfd. by Kyoto Electronics Manufacturing Co., Ltd.), an apparent product thermal conductivity was measured in accordance with the same procedure as a procedure for obtaining the thermal conductivity of a substance formed in a single layer.

1) Non-Steady Hot Wire Method

The non-steady hot wire method is different from a steady (hot wire) method and obtains the thermal conductivity by using a transient phenomenon of heat transfer. A measurement principle thereof in the case of a solid sample will be described. When electric energy is supplied to a linear metal resistance wire (hot wire or heater wire) sandwiched between two sheets of the sample, Joule heat is generated and is radially diffused in a plane perpendicular to the wire, so that the temperature of the sample contacted to the hot wire is quickly increased. In this case, based on a degree of difficulty in heat diffusion in the sample, a state of the temperature rise varies depending on the sample.

Figure 4:
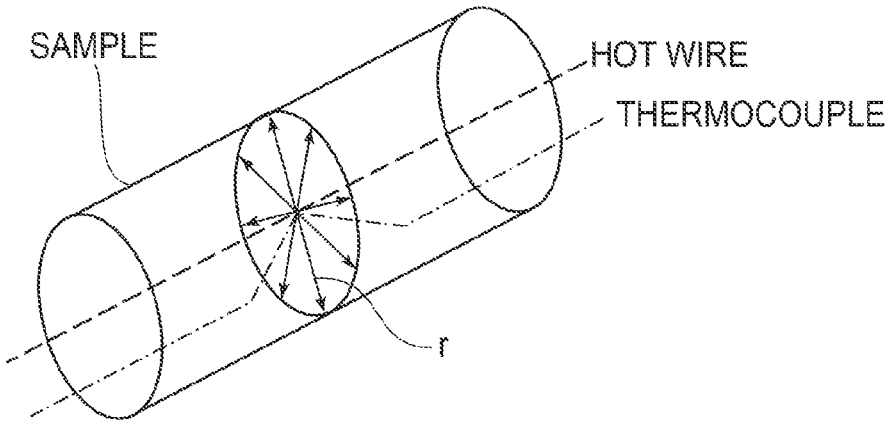
FIG. 4 is a schematic view showing heat spread from a heat source assumed in an infinite sample.

The principle of this measuring method is such that a time dependency of a rate of this temperature rise is associated with the thermal conductivity to obtain the thermal conductivity from the associated temperature rise rate. A calculating formula of the thermal conductivity by this method is obtained from a theoretical formula in the following manner. First, a (recti-)linear heat source (hot wire) with a thickness-less infinite length in an infinitely diffused medium is assumed. Assuming that heat diffused from the hot wire is two-dimensionally diffused in a plane perpendicular to the hot wire as shown in FIG. 4, a temperature change at a point of a distance r from the hot wire is represented by the following formula (1):

$$\frac{\partial T}{\partial t} = k\left(\frac{\partial^2 T}{\partial r^2} + \frac{1}{r}\cdot\frac{\partial T}{\partial t}\right) \tag{1}$$

where T represents a temperature, t represents a time and k represents a thermal diffusitivity. Here, k is represented as follows:

$$k = \frac{\lambda}{\rho\cdot Cp}$$

wherein ρ represents a density and Cp represents a specific heat capacity.

When the formula (1) is solved by the following three conditions:

$$t=0,\ T=0\ (0\leq r<\infty)$$

$$t>0,\ T=0\ (r\rightarrow\infty)$$

$$t=0,\ Q=2xr\lambda\cdot\delta T/\delta r$$

the following formula (2) is obtained.

$$T = \frac{q}{4\pi\lambda}\left[-Ei\left(-\frac{r^2}{4kt}\right)\right] \tag{2}$$

In the formula (2), q represents a dissipated heat quantity from the heat source, λ represents the thermal conductivity and Ei represents exponential integral given by the following formula (3).

$$-Ei(-x) = \int_x^\infty \frac{1}{x}\exp(-x)dx = -C - Inx + \frac{x}{1\cdot 1!} - \frac{x^2}{2\cdot 2!} \tag{3}$$

In the formula (3), C=0.5772 . . . which is called the Euler's constant. In the case where $r^2/4kt$ is sufficiently small, the third term and the later of the formula (3) can be omitted, so that the formula (3) is −Ei(−x)=−C−ln x and therefore the formula (2) is represented by the following formula (4).

$$T = \frac{Q}{4\pi\lambda}\left(\ln\frac{4kt}{r^2} - C\right) \tag{4}$$

Figure 5:
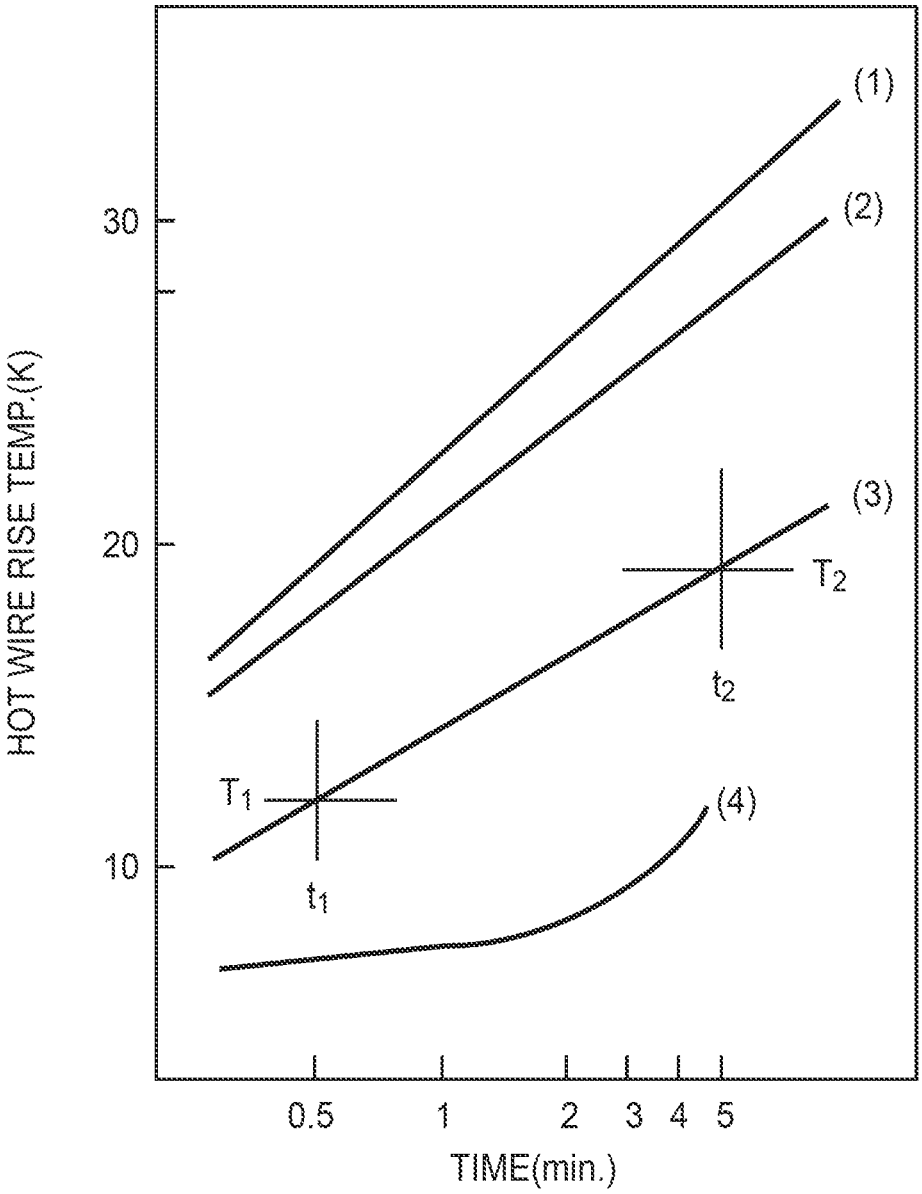
FIG. 5 is a graph showing a relationship between a heater wire rise temperature and an elapsed time.

The formula (4) provides rectilinear lines as shown in FIG. 5 when the temperature (T) of the sample contacted to the hot wire is plotted on a semi-logarithmic graph in which the time is taken as a logarithmic axis (log t), and shows that the thermal conductivity is included in a gradient of T−log t. Therefore, within a range satisfying the formula (4), when the temperatures at arbitrary times $t_1$ and $t_2$ are $T_1$ and $T_2$, the following formula (5) is satisfied.

$$T_2 - T_1 = \frac{Q}{4\pi\lambda}\cdot\ln\frac{t_2}{t_1} \tag{5}$$

Therefore, a current I(A) is passed through a metal wire having an electric resistance R (Ω/m) and the metal wire is used as the heat source, and thereafter when a temperature rise $T_2-T_1$ in the neighborhood of the heat source is measured in a period from $t_1$ to $t_2$ (sec or min), the thermal conductivity λ is calculated from the following formula (6).

$$\lambda = \frac{I^2R}{4\pi}\cdot\frac{\mathrm{Ln}(t_2/t_1)}{T_2 - T_1} \tag{6}$$

A measuring point (place) of the temperature rise (T) may desirably be close to the heater wire and therefore in actuality, the measurement is conducted in the sample contacted to the heater wire, i.e., in a state in which an end of a temperature measuring junction of the thermocouple is contacted to the heater wire.

2) Probe

An ideal measuring method using the probe is, as shown in FIG. 4, required to pass the hot wire (heater wire) through the center of the sample which can be regarded as being infinite but is required to be destroyed depending on a shape of an object to be measured (sample).

Figure 6:
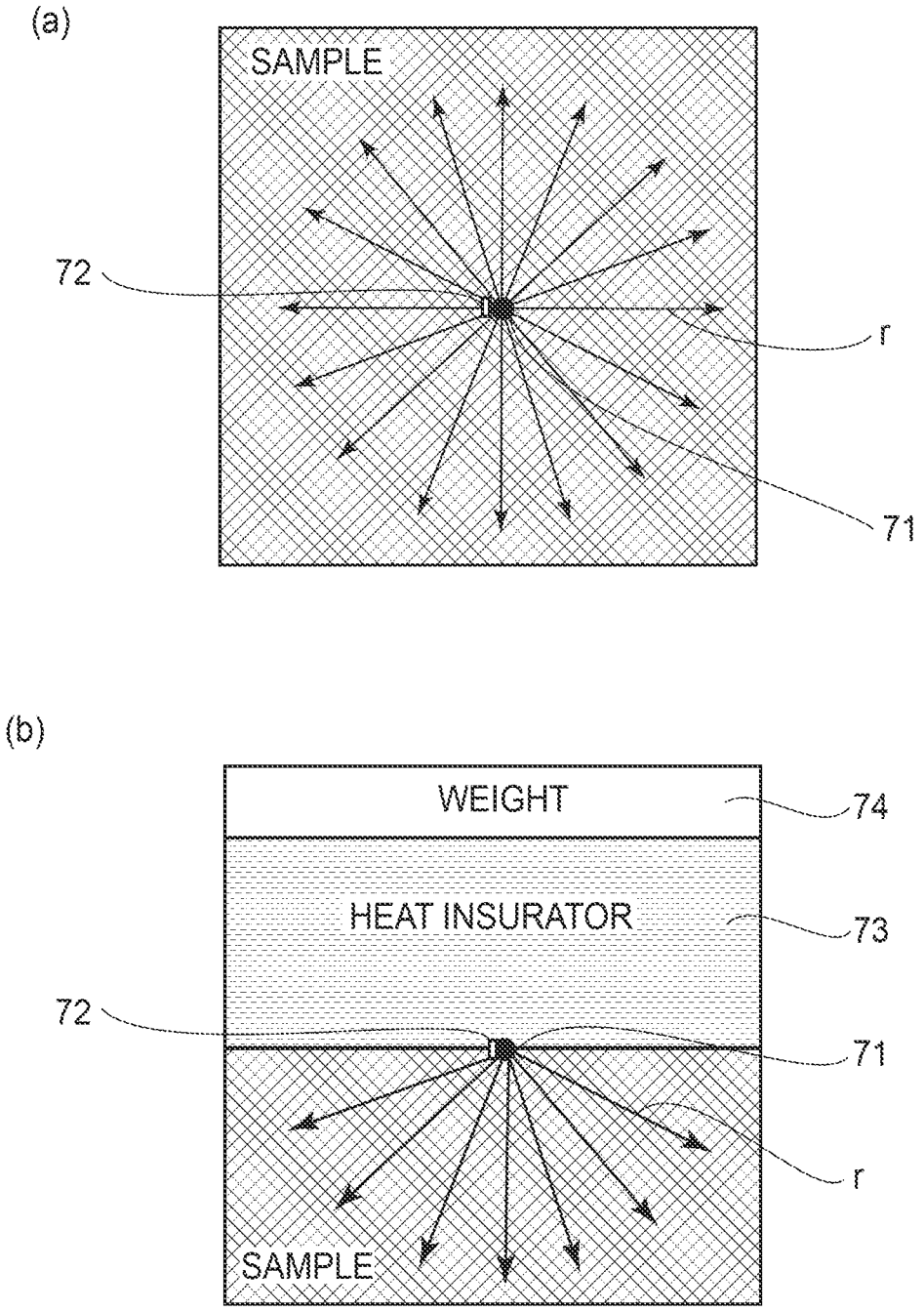
FIGS. 6(*a*) and 6(*b*) are illustrations of a probe ("PD-13") of a measuring device ("QTM-500").

The probe ("PD-13") of the measuring device ("QTM-500") is, as shown in FIG. 6, constituted by a heater wire 71, a thermocouple 72 and an heat insulating material 73 so that the object to be measured (sample) can be subjected to the measurement in a non-destructive manner. FIG. 6(*a*) shows the ideal measuring method and on the other hand, FIG. 6(*a*) shows an actual measuring constitution (method). The heater wire 71 is contacted to the sample and the periphery of the heater wire 71 is heat-insulated by the heat insulating material 73. When a constant current is passed through the heater wire 71, heat generated in the heater wire 71 is thermally transferred to the periphery of the heater wire 71. The heat insulating material 73 of the probe is constituted by a material with a very small thermal conductivity and therefore a surface temperature change of the heater wire 71 depends on the thermal conductivity of the sample.

When the dissipated heat quantity per unit length of the heater wire 71 and per unit time is q (Watt/m) and an increment of surface temperature (rise) of the heater wire 71 from the time $t_1$ to the time $t_2$ is ΔT, the thermal conductivity measured by the measuring device (QTM-500) using the probe (PD-13) is given by the following equation:

$$\text{Thermal conductivity}=18.33\times q/\Delta T\times\log(t_1/t_2)\ \text{(W/mk)}.$$

Thus, when the temperature is plotted on the graph in which the abscissa represents the logarithm of the time t and the ordinate represents the temperature rise ΔT, the rectilinear line is obtained. From the gradient of this rectilinear line, the thermal conductivity can be obtained. The thus-obtained thermal conductivity is used as the "actually measured thermal conductivity". Incidentally, in this embodiment, the reason why the term "actually measured thermal conductivity", not the "thermal conductivity" is as follows.

In the above-described measuring method, when the sample is constituted by a single material and is infinitely large in size with respect to a thickness direction (in which the sample extends away from the heater wire), there is no influence of the thermal capacity on the thermal conductivity of the sample. However, the actually measured value is influenced by the thermal capacity. This is attributable to such a phenomenon that a temperature rise gradient in the sample becomes larger with a smaller thermal capacity of the sample when the thermal capacity of the sample is finite, which cannot be regarded as infinite, and thus the (T-logt) rectilinear line is deviated from that in the case where the sample is infinite.

When the sample becomes the size regarded as being infinite (100×50×20 or more for the probe (PD-13)), the resultant value is a pure (true) thermal conductivity but in the case where the volume (size) is less than the above volume, the thermal conductivity is influenced by the thermal capacity of the sample.

Further, each of the roller 30 and the back-up member 40 is not an integral material but is constituted by several layers and therefore the thermal conductivity of the material for a specific layer cannot be measured by the measuring method in this embodiment. Therefore, in this embodiment, the several layers are regarded as an integral heat transfer source, so that the measured value of the thermal conductivity by the measuring method described above is defined as the actually measured thermal conductivity. That is, the "actually measured thermal conductivity" has the same meaning as the temperature rise rate in the neighborhood of the surface of the object to be measured to which a predetermined heat quantity is supplied.

Incidentally, as described above, the actually measured thermal conductivity is a value in which the thermal capacity of the sample is also reflected in addition to the thermal conductivity of the sample. This is also the reason why the actually measured thermal conductivity influences not only the non-sheet-passing portion temperature rise but also a sleep FPOT described later.

3) Measuring Method

Figure 7:
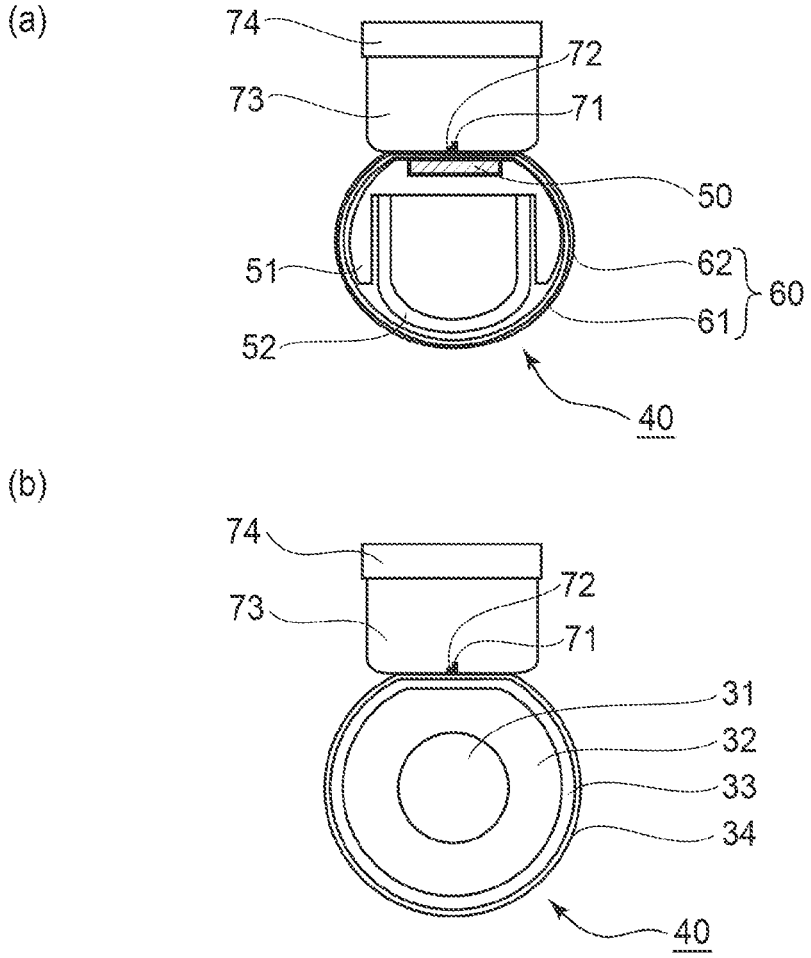
FIGS. 7(*a*) and 7(*b*) are schematic views for illustrating a measuring method of an actual thermal conductivity.

In the measurement in this embodiment, the probe (PD-13) for the measuring device (QTM-500) is used for measuring the actually measured thermal conductivity of the back-up member 40 as shown in FIG. 7(*a*). The heater wire 71 and the thermocouple 72 for measuring the temperature of the heater wire 71 are contacted to the objected to be measured. Then, a certain pressure (10 kgf) was applied by a pressing member 74 via the heat insulating material 73 of the probe. Further, the measurement was made in a normal mode of the measuring device (QTM-500) by selecting a current value depending on the material of the sample.

First, the method (FIG. 7(*a*)) for measuring the actually measured thermal conductivity of the back-up member 40 will be described. The above-described probe was placed on a fixing nip corresponding portion in the constitution of the back-up member 40 and was subjected to the measurement under application of the certain pressure. In order to measure the influence of the material of the pad 50 on the heat transfer, only the pad 50 was replaced and then the actually measured thermal conductivity at the back-up member surface in the associated fixing nip was measured.

For measuring the amount thermal conductivity of the roller 30, the measurement was made in a constitution as shown in FIG. 7(*b*) similarly as in the above-described measuring method. Incidentally, a longitudinal length of each of the back-up member 40 and the roller 30 was 233 mm.

Three types of the material for the pad 50 were prepared and then the actually measured thermal conductivity of the back-up member 40 was measured when each of the pads was placed. A result is shown in Table 1. A measurement result of the actually measured thermal conductivity of the roller 30 is shown in Table 2.

TABLE 1

| Pressing pad | Thickness | Width | A.M.T.C.*1 (W/mk) |
|---|---|---|---|
| Mold | 1 mm | 7.5 mm | 0.14 |
| Aluminum | 1 mm | 7.5 mm | 0.45 |
| Copper | 1 mm | 7.5 mm | 0.67 |

*1"A.M.T.C." represents the actually measured thermal conductivity of the back-up member surface.

TABLE 2

| Roller 30 | Diameter | Layer 32 | Layer 33 | Layer 34 | A.M.T.C.*1 (W/mk) |
|---|---|---|---|---|---|
| Roller (1) | ϕ16 | B.R.*2 2.0 mm | H.H.T.R.*4 200 μm | PFA 10 μm | 0.19 |
| Roller (2) | ϕ16 | B.R.*2 1.8 mm | H.H.T.R.*4 400 μm | PFA 10 μm | 0.41 |
| Roller (3) | ϕ16 | B.R.*2 1.6 mm | H.H.T.R.*4 600 μm | PFA 10 μm | 0.60 |
| Solid Roller | ϕ16 | S.R.*3 2.5 mm | — | PFA 10 μm | 0.83 |

*1"A.M.T.C." represents the actually measured thermal conductivity of the fixing roller surface.
*2"B.R." represents a balloon rubber.
*3"S.R." represents a solid rubber.
*4"H.H.T.R." represents a high heat transfer rubber.

(3-4) Checking by Experiment

Next, checking was made by experiments as to how to influence of the actually measured thermal conductivity of each of the roller 30 and the back-up member 40 on the FPOT of the fixing device 7 and the non-sheet-passing portion temperature rise.

The process speed of the image forming apparatus used in the experiments was 100 mm/sec, and the experiments were conducted by using a laser beam printer for effecting printing on 16 sheets per min. In the experiments, the fixing device 7 in this embodiment was used.

Further, as a comparative embodiment, comparative fixing devices 7A to 7F were prepared. Members and portions common to the fixing device 7 in this embodiment and the fixing devices 7A to 7F in the comparative embodiment are omitted from the description.

The comparative fixing devices 7A to 7F were constituted so that the actually measured thermal conductivity of each of associated fixing rollers 30 and back-up members 40 was as shown in Table 3. Other constitutions of the comparative fixing devices 7A to 7F are the same as those of the fixing device 7 in this embodiment.

TABLE 3

| | EMBODIMENT | | | | | | |
|---|---|---|---|---|---|---|---|
| | 1 | 7A | 7B | 7C | 7D | 7E | 7F |
| FR*1 | (1) | (1) | (2) | (2) | (3) | (3) | S |
| FRTC*2 | 0.19 | 0.19 | 0.41 | 0.41 | 0.60 | 0.60 | 0.83 |
| BM*3 | Al | Mold | Al | Mold | Al | Cu | Mold |
| BMTC*4 (W/mk) | 0.45 | 0.14 | 0.45 | 0.14 | 0.45 | 0.67 | 0.14 |

*1"FR" represents the fixing roller.
*2"FRTC" represents the actually measured thermal conductivity of the fixing roller surface.
*3"BM" represents the back-up member.
*4"BMTC" represents the actually measured thermal conductivity of the back-up member surface.
*5"SR" represents the solid roller.

Figure 8:
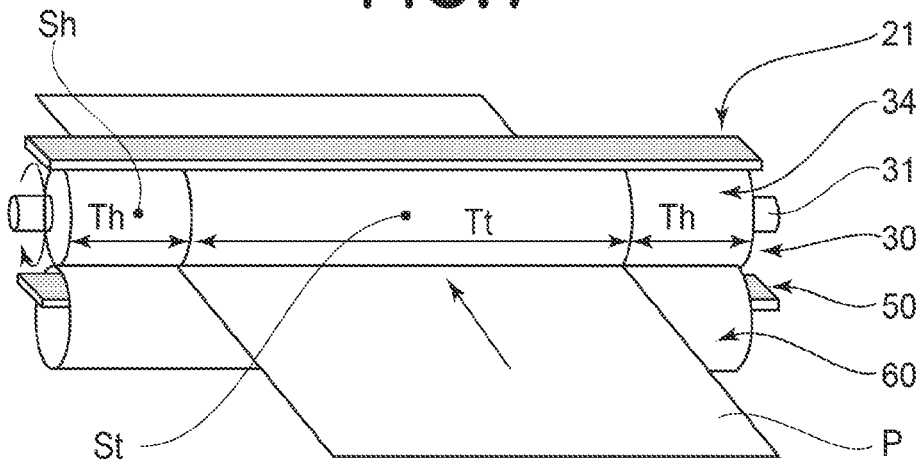
FIG. 8 is a perspective view showing a fixing roller temperature measuring position of the fixing device in Embodiment 1.

In the image forming apparatus in the experiments, the heater 21 is controlled so that the detection temperature of the thermistor 23 is the target temperature of 200-210° C., e.g., in the case where paper (sheet) with a basis weight of 80 g/m$^2$ is subjected to the fixation. FIG. 8 shows a temperature measurement position of the roller 30 in the experiments. The temperature was measured by pressing a type K thermocouple (mfd. by Anritsu Corp.) against a temperature measurement position Sh of a non-sheet-passing portion Th of the roller 30 and a temperature measurement position St of a sheet-passing portion Tt of the roller 30.

<Experiment 1>

In this experiment, the above image forming apparatus was used and in an environment of an ambient temperature of 15° C. and a relative humidity of 15% RH, a general LBP print sheet (basis weight: 80 g/m$^2$, A4-sized (width: 210 mm, length: 297 mm) paper) was used. In a state in which the fixing device 7 was cooled to the ambient temperature (sleeve state), predetermined electric power was turned on and a character image with a print ratio of 5% was formed (printed) on a single sheet, so that a time until the sheet was discharged to the outside of the image forming apparatus (sheet FPOT) was measured. In the above condition, a comparison of the sleep FPOT between the fixing device 7 and the fixing devices 7A to 7F was made.

Here, the sleep FPOT refers to a time from a print start signal (input), after the Predetermined electric power is supplied to the fixing device 7 in the sleep state, until a fixing operation for the first sheet of the recording material is completed and then is discharged. The fixing operation is started from the time when the surface temperature of the roller 30 reaches 180° C. and therefore the sleep FPOT can be more reduced with a higher surface temperature rise rate of the roller 30. In this embodiment, a target sleep FPOT was set at 20 sec or less.

<Experiment 2>

In the same experiment environment as in Experiment 1, paper of 80 g/m$^2$ in basis weight and A5 (width: 148 mm, length: 210 mm) in size was used and the character image of 5% in print ratio was continuously printed on 100 sheets of the paper. Immediately after this continuous printing, a temperature difference between temperatures at the temperature measurement position Sh of the non-sheet-passing portion Th of the roller and the temperature measurement position St of the sheet-passing portion Tt of the roller 30 was measured. Further, immediately after the continuous printing, whether or not improper image quality (image defect) occurs when latter-sized paper which was wider than the A5-sized paper and which was passed through a region, corresponding to the sheet-passing portion of the roller 39 which, corresponds to the non-sheet-passing portion of the roller 30 at the time of passage of the A5-sized paper was checked.

A result of evaluation as the whether or not compatibility between achievement of the target sleep FPOT in Experiment 1 and prevention of the improper image quality (image defect) due to the non-sheet-passing portion temperature rise in Experiment is realized is shown in Table 4.

TABLE 4

| | EMBODIMENT | | | | | | |
|---|---|---|---|---|---|---|---|
| | 1 | 7A | 7B | 7C | 7D | 7E | 7F |
| FRTC*1 | 0.19 | 0.19 | 0.41 | 0.41 | 0.60 | 0.60 | 0.83 |
| BMTC*2 (W/mk) | 0.45 | 0.14 | 0.45 | 0.14 | 0.45 | 0.67 | 0.14 |
| EXP. 1 SLEEVE FPOT | 9s | 7s | 13s | 11s | 17s | 20s | 23s |
| EXP. 2 TD*3 (° C.) | 18 | 50 | 17 | 30 | 20 | 13 | 10 |
| EXP. 3 ID*4 | No | Yes | No | Yes | Yes | No | No |
| Compatibility*5 | Yes | No | Yes | No | No | Yes | No |

*1"FRTC" represents the actually measured thermal conductivity of the fixing roller surface.
*2"BMTC" represents the actually measured thermal conductivity of the back-up member surface.
*3"TD" represents the temperature difference between the sheet-passing portion and the non-sheet-passing portion.
*4"ID" represents the image defect (improper image quality. "Yes" represents that the image defect occurred. "No" represents that the image defect did not occur.
*5"Compatibility" represents compatibility between the achievement of the target sleep FPOT and the prevention of the image defect due to the non-sheet-passing portion temperature rise. "Yes" represents that the compatibility is realized. "No" represents that the compatibility is not realized.

Of the fixing devices 7 and 7A to 7F used in Experiments 1 and 2, the fixing devices capable of realizing the compatibility between the target sleep FPOT (20*s* or less) and the prevention of the occurrence of the image defect were the fixing device 7 in Embodiment 1 and the comparative fixing devices 7B and 7E. Further, the fixing devices having the constitution in which the actually measured thermal conductivity of the back-up member 40 is larger than the actually measured thermal conductivity of the roller 30 are the fixing device 7 in Embodiment 1 and the comparative fixing devices 7B and 7E. Other fixing devices cannot realize the compatibility between the reduction in sleep FPOT and the prevention of the occurrence of the image defect due to the non-sheet-passing portion temperature rise.

From this result, it is understood that the compatibility between the reduction in sleep FPOT and the prevention of the occurrence of the image defect due to the non-sheet-passing portion temperature rise can be realized by employing the constitution in which the actually measured thermal conductivity of the back-up member 40 is larger than the actually measured thermal conductivity of the fixing roller 30.

A degree of the influence on the sleep FPOT is larger by the actually measured thermal conductivity of the roller 30 than by the actually measured thermal conductivity of the back-up member 40. Of the fixing device 7 in Embodiment 1 and the comparative fixing devices 7B and 7E, the fixing device 7 in Embodiment 1 for which the actually measured thermal conductivity is the smallest realizes the shortest (fastest) sleep FPOT.

The setting of the value of the target sleep FPOT is influenced, depending on the specifications of each type of the image forming apparatus. But when the actually measured thermal conductivity of the roller 30 is excessively high, the sleep FPOT becomes very slow (long). Therefore, in order to realize a fixing device of the energy saving type, in which the electric power supply to the roller 30 is not effected until the printing is started, there is a need to suppress the sleep FPOT at about 20 sec or less, so that the actually measured thermal conductivity of the roller 30 may preferably be 0.6 (W/mk) or less.

When the actually measured thermal conductivity of the roller 30 is 0.6 (W/mk) or less, the uniformizing performance of the temperature difference between the non-sheet-passing portion and the sheet-passing portion by the fixing roller itself deteriorates. When the actually measured thermal conductivity of the back-up member 40 is larger than the actually measured thermal conductivity of the roller 30, the temperature difference between the non-sheet-passing portion and the sheet-passing portion can be made small.

From the results of Experiments 1 and 2, by the constitution in this embodiment, it can be said that the reduction in FPOT and the prevention of the image defect due to the non-sheet-passing portion temperature rise can be compatibly realized.

[Embodiment 2]

A second exemplary embodiment is described.

Figure 9:
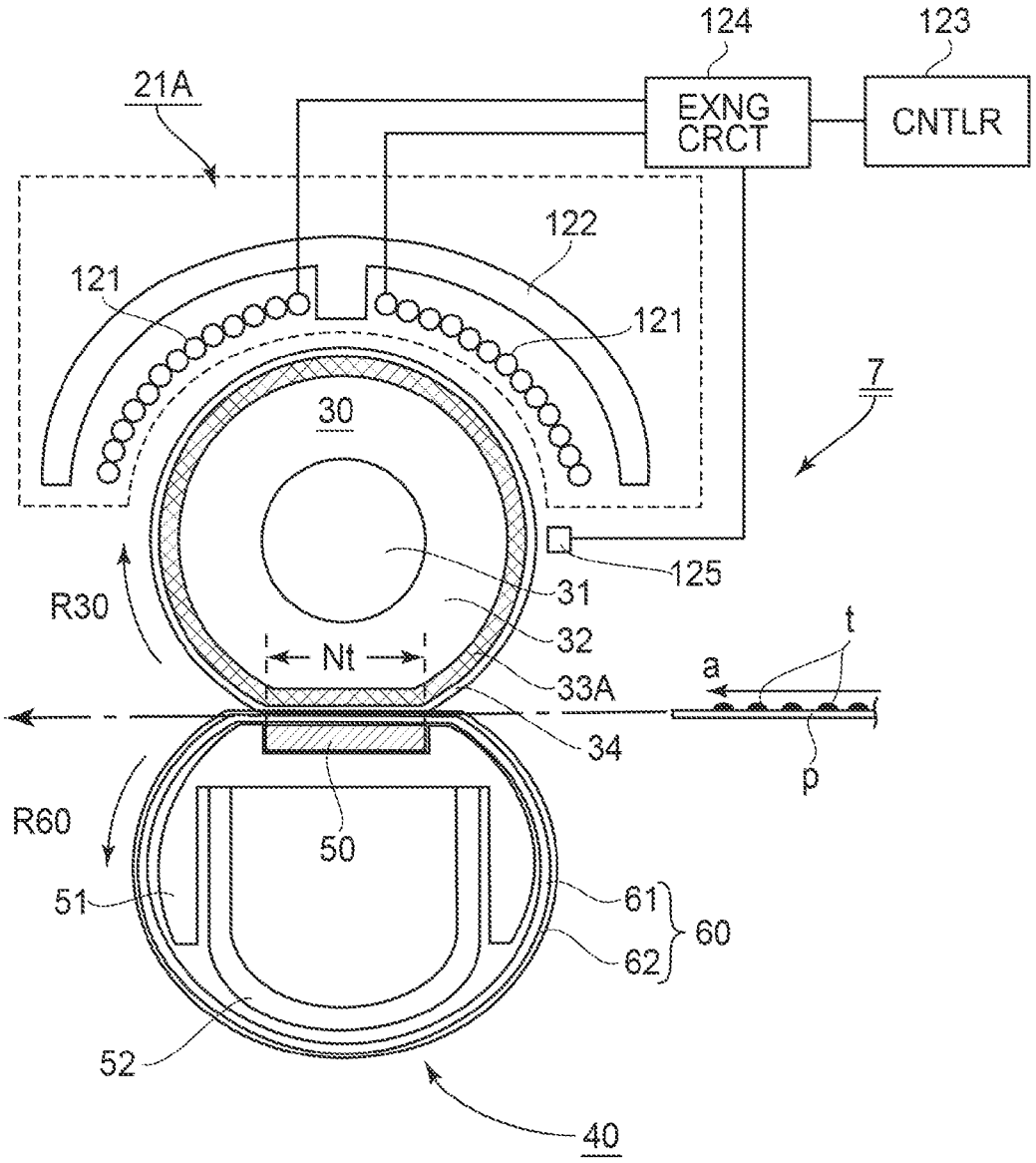
FIG. 9 is a sectional view showing a schematic structure of a fixing device in Embodiment 2.

FIG. 9 is a cross-sectional view showing a schematic structure of a fixing device 7 in Embodiment 2. In this embodiment, the fixing device 7 is characterized by using an induction heating member (magnetic field generating member) as an external heating member 21A for a fixing roller 30.

In the fixing device 7 in this embodiment, the roller 30 is prepared by replacing the high heat transfer layer 33 of the roller 30 in the fixing device in Embodiment 1 with a metal sleeve 33A having an electromagnetic induction heat generating property. The sleeve 33A is, as described later, subjected to induction heating by the action of a magnetic field by the magnetic field generating member 21A provided in non-contact to and opposed to the outer peripheral surface of the roller 30.

The material for the sleeve 33A comprises an electroconductive member having a magnetic property such that it is capable of generating heat by induction heating, such as iron or SUS, and particularly comprises the electroconductive member which may only be required to have high relative permeability, so that, e.g., a silicon steel plate, an electromagnetic steel plate and a nickel steel plate may suitably be used. Further, even when the material is a non-magnetic material, also a material which is capable of being induction-heated and which has a high resistance value, such as SUS304 may suitably be used. Further, even in the case where the material is a non-magnetic material based member such as ceramics, when a constitution in which the material having the high relative permeability is disposed so as to have the electroconductivity is employed, such a material can also be used.

Further, the sleeve 33A is reduced in thickness to 40-100 μm in order to reduce the surface temperature rise time of the roller 30. In this embodiment, as the sleeve 33A, a 50 μm-thick magnetic stainless steel member (SUS 430) is used. Further, in this embodiment, in order to increase the thermal capacity, it is also possible to form the sleeve 33A with a plurality of electroconductor layers.

In order to uniformly fix the color toner, an about 100 to 400 μm-thick Si rubber layer may also be provided as desired between the sleeve 33A and a parting layer 34. A heat insulating layer 32 is a 3 mm-thick layer formed principally of a silicone rubber (foam rubber) or the like having a high heat insulating property. The parting layer 34 is a 10 μm-thick layer of PFA. Other roller constitutions are the same as those of the roller 30 in Embodiment 1.

The magnetic field generating member 21A for externally heating the roller 30 is provided in non-contact to and opposed to an upper-half peripheral surface of the roller 30 and includes an induction coil 121 and a ferrite core 122. The coil 121 is disposed so that it is wound to surround the upper-half peripheral surface of the roller 30. When the coil 121 is disposed so as to surround the upper-half peripheral surface of the roller 30, curvature is present and therefore magnetic flux is concentrated in a center side of the coil 121, so that an amount of generation of eddy current is increased in the sleeve 33A. As a result, it becomes possible to quickly increase the surface temperature of the roller 30.

As the material for the coil 121, in this embodiment, in consideration of a heat-resistant property, an aluminum solid wire having the surface where an insulating layer (such as an oxide layer) is formed is used but it is also possible to use a copper wire, a copper-based composite member wire or the Litz wire consisting of strands of enamelled wire or the like. In this case, even when either of the wire materials is selected, in order to suppress joule loss of the coil 121, a total resistance value of the coil 121 may be 0.5Ω or less, preferably be 0.1Ω or less.

Further, the coil 121 can also be divided into a plurality of coil portions depending on the size of the recording material P and then may be disposed. In this case, the coil 121 is disposed so as to surround the outer peripheral portion of the roller 30 at least in a range of about half-circumference. As a result, the roller 30 can be uniformly heated in a short time.

The back-up member 40 has the same constitution as that of the fixing device 7 in Embodiment 1. The back-up member 40 is provided under the roller 30 (in a side which is 180-degree opposite from the side where the magnetic field generating member 21A is provided). Further, a fixing nip Nt with a predetermined width is formed between the roller 30 and the film 60. In this embodiment, the fixing nip Nt is configured to have the width of about 6 mm.

When the roller 30 is rotationally driven, a high-frequency current is passed through the coil 121 by an exciting circuit 124 controlled by a controller 123 constituted by a central processing unit (CPU) and the like. As a result, an AC magnetic field is generated in the coil 121 and by the action of this AC magnetic field, the sleeve 33A is induction-heated to generate the heat.

To the exciting circuit 124, a thermistor 125, as a temperature detecting member, provided in the neighborhood of an entrance of the fixing nip Nt of the roller 30, is connected. The thermistor 125 controls the exciting circuit 124 via the controller depending on its detection signal, so that the temperature of the roller 30 is controlled at a predetermined set temperature (e.g., 180 ° C.).

In a state in which the detection temperature of the surface of the roller 30 by the thermistor 125 is kept at a fixable temperature (target temperature), the recording material P on which the unfixed toner image t is carried is guided into the fixing nip Nt. The recording material P is nip-conveyed in the fixing nip Nt by the surface of the roller 30 and the film 60. Further, during the nip-conveyance process, the unfixed toner image t on the recording material P is heat-fixed as a fixed image on the recording material P by the heat of the roller 30 and the nip pressure.

1) Measurement of Actually Measured Thermal Conductivity

The actually measured thermal conductivity of the roller 30 in Embodiment 2 was measured. The measuring method is the same as that in Embodiment 1 and therefore will be omitted from the description. A result is shown in Table 5.

TABLE 5

| Fixing roller | Diameter | Layer 32 | Sleeve 33A | Layer 34 | A.M.T.C.*1 (W/mk) |
|---|---|---|---|---|---|
| Heating Roller | ϕ18 | B.R.*2 3 mm | SUS 50 μm | PFA 10 μm | 0.31 |

*1"A.M.T.C." represents the actually measured thermal conductivity of the fixing roller surface.
*2"B.R." represents a balloon rubber.

2) Checking by Experiments

An effect in the constitution of Embodiment 2 was checked by experiments. The experiment condition is the same as that in Experiments 1 and 2 in Embodiment 1 and therefore will be omitted from the description. In the experiments, as the pad 50 of the back-up member 40, an aluminum plate which is the same as that used in Embodiment 1 was used. A constitution used in the experiments is shown in Table 6. The results of the experiments are shown in Table 7. of the experiments is shown in Table 7.

TABLE 6

| EMB. 2 | | |
|---|---|---|
| Constitution | Fixing roller | Heating roller |
| | FRTC*1 (W/mk) | 0.31 |
| | Back-up member | Aluminum |
| | BMTC*2 (W/mk) | 0.45 |

*1"FRTC" represents the actually measured thermal conductivity of the fixing roller surface.
*2"BMTC" represents the actually measured thermal conductivity of the back-up member surface.

TABLE 7

| EMB. 2 | | |
|---|---|---|
| Constitution | FRTC*1 (W/mk) | 0.31 |
| | BMTC*2 (W/mk) | 0.45 |
| Experiment 1 | SLEEP FPOT | 15 s |
| Experiment 2 | TD*3 | 16° C. |
| | ID*4 | No |
| Compatibility*5 | | Yes |

*1"FRTC" represents the actually measured thermal conductivity of the fixing roller surface.
*2"BMTC" represents the actually measured thermal conductivity of the back-up member surface.
*3"TD" represents the temperature difference between the sheet-passing portion and the non-sheet-passing portion.
*4"ID" represents the image defect (improper image quality. "No" represents that the image defect did not occur.
*5"Compatibility" represents compatibility between the achievement of the target sleep FPOT and the prevention of the image defect due to the non-sheet-passing portion temperature rise. "Yes" represents that the compatibility is realized.

Also in the constitution of the fixing device as in Embodiment 2, the effect similar to that in Embodiment 1 was obtained. That is, it is possible to compatibly realize the reduction in sleep FPOT and the image defect prevention by the suppression of the non-sheet-passing portion temperature rise by making the actually measured thermal conductivity of the surface forming the fixing nip of the back-up member 40 larger than the actually measured thermal conductivity of the surface of the roller 30.

[Other Embodiments]

1) In the above, in the fixing devices 7 in Embodiments 1 and 2, as the heating member for externally heating the roller 30, the constitution in which the plate-like heater 21 and the induction heating member 21A are used to heat the surface layer of the roller 30 was described as an example.

However, the heating member for externally heating the roller 30 is not limited to the above members. For example, the shape of the heater is not required to be the plate-like shape but may also be a curved shape which follows the roller surface. A constitution in which a protective sheet is provided on the heater 21 in place of the protective layer 21*d* of the heater 21 and forms the heat press-contact portion Nh between its surface and the surface of the roller 30 may also be employed. Further, a constitution in which a film is interposed between the heater 21 and the roller 30 to form the heat press-contact portion Nh may also be employed. Further, by using a halogen lamp, the fixing roller surface may also be heated in a non-contact manner.

2) The image heating apparatus according to the present invention is not limited to the fixing device 7 used for the unfixed toner image is Embodiments 1 and 2. The image heating apparatus can also be effectively used as a glossiness increasing device (image modifying device) for increasing a glossiness of the image by heating the image fixed on the recording material.

3) In the image forming apparatus, the image forming portion for forming the unfixed toner image t on the recording material P is not limited to that of the transfer type using the electrophotographic process as in Embodiments 1 and 2. The image forming portion may also be a direct type using photosensitive paper and the electrophotographic process. Further, the image forming portion may also be of the transfer type or direct type using an electrostatic recording process or a magnetic recording process.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 137209/2011 filed Jun. 21, 2011, which is hereby incorporated by reference.

What is claimed is:

1. An image heating apparatus for heating a toner image formed on a recording material while conveying the recording material in a nip portion, the image heating apparatus comprising:

a fixing roller;

a heating member configured to heat the fixing roller; and a back-up unit including a cylindrical film and a metal plate which contacts an inner surface of the film, wherein the nip portion is formed between said fixing roller and said film by the metal plate press-contacting said film to said fixing roller, the nip portion extending from a recording material entrance portion which the recording material in a non-nipped state enters to a recording material exit portion, and an entirety of the nip portion is formed only by the fixing roller and the metal plate through the film.

2. An image heating apparatus according to claim 1, wherein the fixing roller includes a metal core, a first rubber layer formed outside the metal core, and a second rubber layer formed outside the first rubber layer, and wherein the second rubber layer has a higher thermal conductivity than the first rubber layer.

3. An image heating apparatus according to claim 2, wherein the heating member contacts an outer surface of the fixing roller.

4. An image heating apparatus according to claim 1, wherein when an outer surface of the film in the nip portion and an outer surface of the fixing roller are supplied with the same quantity of heat respectively, a temperature rise rate in a neighborhood of the outer surface of the film supplied with the heat is higher than the temperature rise rate in the neighborhood of the outer surface of the fixing roller.

5. An image heating apparatus according to claim 1, wherein the metal plate has a rectangular sectional shape.

6. An image heating apparatus for heating a toner image formed on a recording material while conveying the recording material in a nip portion, the image heating apparatus comprising:

a fixing roller;

a heating member configured to heat the fixing roller; and a back-up unit including a cylindrical film and a metal plate which contacts an inner surface of the film and forms the nip portion with the fixing roller through the film, wherein the nip portion is formed between said fixing roller and said film by the metal plate press-contacting said film to said fixing roller, the nip portion extending from a recording material entrance portion which the recording material in a non-nipped state enters to a recording material exit portion, and with respect to a conveyance direction of the recording material at the nip portion, an entirety of the metal plate is provided only in a contact area where the film contacts an outer surface of the fixing roller.

7. An image heating apparatus according to claim 6, wherein the fixing roller includes a metal core, a first rubber layer formed outside the metal core, and a second rubber layer formed outside the a first rubber layer, and wherein the second rubber layer has a higher thermal conductivity than the first rubber layer.

8. An image heating apparatus according to claim 7, wherein the heating member contacts the outer surface of the fixing roller.

9. An image heating apparatus according to claim 6, wherein when an outer surface of the film in the nip portion and an outer surface of the fixing roller are supplied with the same quantity of heat respectively, a temperature rise rate in a neighborhood of the outer surface of the film supplied with the heat is higher than the temperature rise rate in the neighborhood of the outer surface of the fixing roller.

10. An image heating apparatus according to claim 6, wherein the metal plate has a rectangular sectional shape.

11. An image heating apparatus for heating a toner image formed on a recording material while conveying the recording material in a nip portion, the image heating apparatus comprising:

a fixing roller;

a heating member configured to heat the fixing roller; and a back-up unit including a cylindrical film, a metal plate contacting an inner surface of the film and forming the nip portion with the fixing roller through the film, and a reinforcement member, made of metal, for reinforcing the back-up unit, wherein the back-up unit includes a supporting member, made of resin, for supporting the metal plate between the metal plate and the reinforcement member.

12. An image heating apparatus according to claim 11, wherein the fixing roller includes a metal core, a first rubber layer formed outside the metal core, and a second rubber layer formed outside the a first rubber layer, and wherein the second rubber layer has a higher thermal conductivity than the first rubber layer.

13. An image heating apparatus according to claim 12, wherein the heating member contacts the outer surface of the fixing roller.

14. An image heating apparatus according to claim 11, wherein when an outer surface of the film in the nip portion and an outer surface of the fixing roller are supplied with the same quantity of heat respectively, a temperature rise rate in a neighborhood of the outer surface of the film supplied with the heat is higher than the temperature rise rate in the neighborhood of the outer surface of the fixing roller.

15. An image heating apparatus according to claim 11, wherein the metal plate has a rectangular sectional shape.

* * * * *